US007722029B2

(12) United States Patent
Gruntjes et al.

(10) Patent No.: US 7,722,029 B2
(45) Date of Patent: May 25, 2010

(54) SHEET FEED METHOD, A SHEET FEEDER, AND AN IMAGE FORMING APPARATUS INCORPORATING THE SHEET FEEDER

(75) Inventors: Marinus T. W. Gruntjes, Horst (NL); Maurice J. M. Bindels, Amersfoort (NL)

(73) Assignee: OCÉ-Technologies B.V., Venlo (NL)

( * ) Notice: Subject to any disclaimer, the term of this patent is extended or adjusted under 35 U.S.C. 154(b) by 597 days.

(21) Appl. No.: 11/515,945

(22) Filed: Sep. 6, 2006

(65) Prior Publication Data

US 2007/0052152 A1 Mar. 8, 2007

(30) Foreign Application Priority Data

Sep. 7, 2005 (EP) ..... 05108187

(51) Int. Cl.
*B65H 3/14* (2006.01)

(52) U.S. Cl. ..... 271/97; 271/30.1; 271/147

(58) Field of Classification Search ..... 271/98, 271/97, 30.1, 147

See application file for complete search history.

(56) References Cited

U.S. PATENT DOCUMENTS 5,165,571 A * 11/1992 Schlumpf ..... 221/213
5,722,652 A * 3/1998 Yoshida et al. ..... 271/11
6,523,821 B2 * 2/2003 Kashiwagi et al. ..... 271/145
6,648,323 B2 * 11/2003 Hsieh ..... 271/126
2002/0066992 A1 * 6/2002 Lim et al. ..... 271/117
2004/0089994 A1 5/2004 Koga et al.

FOREIGN PATENT DOCUMENTS

DE 19536425 A1 4/1996
JP 11193138 A 7/1999
JP 2004043186 A 2/2004

* cited by examiner

*Primary Examiner*—Patrick H Mackey
*Assistant Examiner*—Michael C McCullough
(74) *Attorney, Agent, or Firm*—Birch, Stewart, Kolasch & Birch LLP

(57) ABSTRACT

A method for use in a sheet feeder having a sheet stacking unit with a bottom plate to support a sheet bundle in which air is blown against a side edge of the sheet bundle near the topmost sheets of the bundle, thereby lifting these sheets from the bundle, and separating the uppermost sheet from the bundle, and conveying this sheet away from the bundle, wherein the lifting of the sheets when the bundle is nearly depleted is assisted by forcing an element situated underneath the bundle to push against the bundle solely when air is blown against the side edge of the bundle. A sheet feeder suitable for applying the present method and an imaging apparatus for incorporating the sheet feeder is also provided.

13 Claims, 4 Drawing Sheets

4A

4B

3A

3B

3C

SHEET FEED METHOD, A SHEET FEEDER, AND AN IMAGE FORMING APPARATUS INCORPORATING THE SHEET FEEDER

This application claims the priority benefits of European Patent Application No. 05108187.5 filed on Sep. 7, 2005 which is hereby incorporated by reference.

BACKGROUND OF THE INVENTION

The present invention pertains to a sheet feed method for use in a sheet feeder having a sheet stacking unit provided with a bottom plate to support a sheet bundle whenever air is blown against a side edge of the sheet bundle near the topmost sheets of the bundle, thereby lifting these sheets from the bundle, separating the uppermost sheet from the bundle, and conveying this sheet away from the bundle. The present invention also pertains a sheet feeder and an imaging apparatus incorporating the sheet feeder.

A sheet feed method is known from US patent application 2004/0089994 A1. This method has been devised in order to be able and reliably feed a very broad range of recording media from the same sheet stacking unit. Nowadays, in printing rooms there are growing requests to form images on cardboard, tracing paper, and all sorts of coated media, etc. Many of such media have very smooth surfaces and with sheet feeding methods based on friction, mis-feeds and double-feeds occasionally occur. In order to mitigate these problems, known methods handle the sheet feeding by first blowing air from a side edge of a paper bundle, causing the uppermost sheets to lift off of the bundle. Then, air is injected between the uppermost and adjacent sheet, providing a very reliable separation of the uppermost sheet from the bundle. The actual separation is effected by using a suction unit, followed by conveying the sheet on a conveying belt. Over the friction based methods, the air separation methods has the advantage of a wide latitude of paper feed setting conditions, combined with the adaptability for high-speed processing, high durability and corresponding low running costs.

The known method however has an important disadvantage. It appears that the reliability of the feeding process decreases significantly when the bundle is nearly depleted, i.e., when less than 25 sheets of receiving media are present, particularly when less than 10 sheets are present. This is not restricted to extraordinary heavy or light media types. For example, with all sorts of plain paper, when less than 5 sheets are present, a mis-feed occasionally occurs. For the lighter types, typically types of less than 100 grams/square meter, the risk of inducing skew increases significantly when less than 5 to 10 sheets are present. Heavier types of media seem to be prone to mis-feeds, in particular when narrow paper formats (SEF) are being used. In order to overcome this problem, it is proposed to leave the last few sheets, typically 25-50 sheets, in the tray and then denote the tray as "empty". These left-over sheets however, have to be removed from time to time, or immediately when another media type is going to be loaded in the sheet stacking unit. This prior art solution therefore is far from ideal.

SUMMARY OF THE INVENTION

The present invention has as an object to overcome or at least mitigate the above-mentioned problems. To this end a method is provided for assisting the lifting of the sheets when the bundle is nearly depleted by forcing an element situated underneath the bundle to push against the bundle, solely when air is blown against the side edge of the bundle. In this method, when the bundle is nearly depleted there is induced an extra force to lift the last few sheets in the direction of the separation unit. Contrary to what one expects, it appears that when only a few sheets are present in the tray, extra help is needed to induce an adequate lift of the sheets in the direction of the separation unit. It is further recognized that this extra help should only be used in connection with the blowing action against the side edge of the bundle. Thus, when the blowing action stops in order to let the remaining sheets fall back to the bottom plate, the element should cease its lifting action. Therefore, the present invention is clearly distinct from the prior art feed methods which make use of bottom elements that constantly force a bundle of sheets upwardly in the direction of a separation unit, for example because part of the bottom is forced upwardly with a spring.

In one embodiment, the blowing of the air creates a pressure difference that forces the element to undertake an upward movement. In this embodiment the mere air blowing action causes the element directly to move in an upward direction. This has the advantage that there is no need for an extra process, next to the air blowing, to provide the element creating the needed lifting force. Next to this, because in this embodiment the element moves upwardly as a direct result of the air blowing process, the prerequisite of an extra force being present only in concurrence with the air blowing action is automatically fulfilled.

In another embodiment, the element is hinged in the bottom plate. In this embodiment the element is connected to the bottom plate at one end but is able to move upwardly because the connection allows a hinging action of the element. This appears to markedly increase the reliability of the present feeding method, most probably because the element will always come back to its original position when the air blowing action stops.

The present invention also pertains to the feeder itself. With respect to the above-identified prior art, the feeder comprises an element that is operatively connected to the stacking unit, the element being constituted such that it undertakes an upward movement solely when air is blown against the side edge of the bundle when it is nearly depleted. The working action of the element has been addressed already hereinabove.

In another embodiment, the element is sheet-like. This has the advantage that the element does not take up too much space, and also, that it can easily be situated between the bottom plate and the sheet bundle. In this way, the element will hardly interfere with the process of filling the stacking unit with a new bundle of sheets.

In a further embodiment the element is a rigid plate that covers a part of the bottom plate. In this embodiment, the element is constituted as a rigid plate in contrast with an element that is constituted as a flexible sheet. This decreases the risk of the element getting damaged by the multiple actions of stacking new bundles of sheets in the stacking unit. A rigid plate is less prone to damaging, such as inducing wrinkles, folds etc., than a sheet-like element.

In yet a further embodiment, the rigid plate is situated essentially adjacent the air blowing means. Surprisingly it appears that it is sufficient for the rigid plate to extend only in the direct vicinity of the air blowing means. Thus, there is no need for a large rigid plate that extends substantially over the complete side edge of the bundle of sheets. This makes the construction of the stacking unit more simple.

As a further improvement, the bottom plate can be provided with a recess in which the rigid plate is situated. In this way, the rigid plate does not constitute an obstruction for the lowermost sheets of a new bundle that is being loaded in the stacking unit. The recess can be made just as deep as the rigid plate is thick such that, in essence, the bottom of the stacking unit remains evenly flat. In this way, there is hardly any chance that sheets get damaged because of the presence of the rigid plate.

BRIEF DESCRIPTION OF THE DRAWING

The present invention will now be exemplified in greater detail by the following figures and accompanying description, wherein.

DETAILED DESCRIPTION OF THE INVENTION

Figure 1:
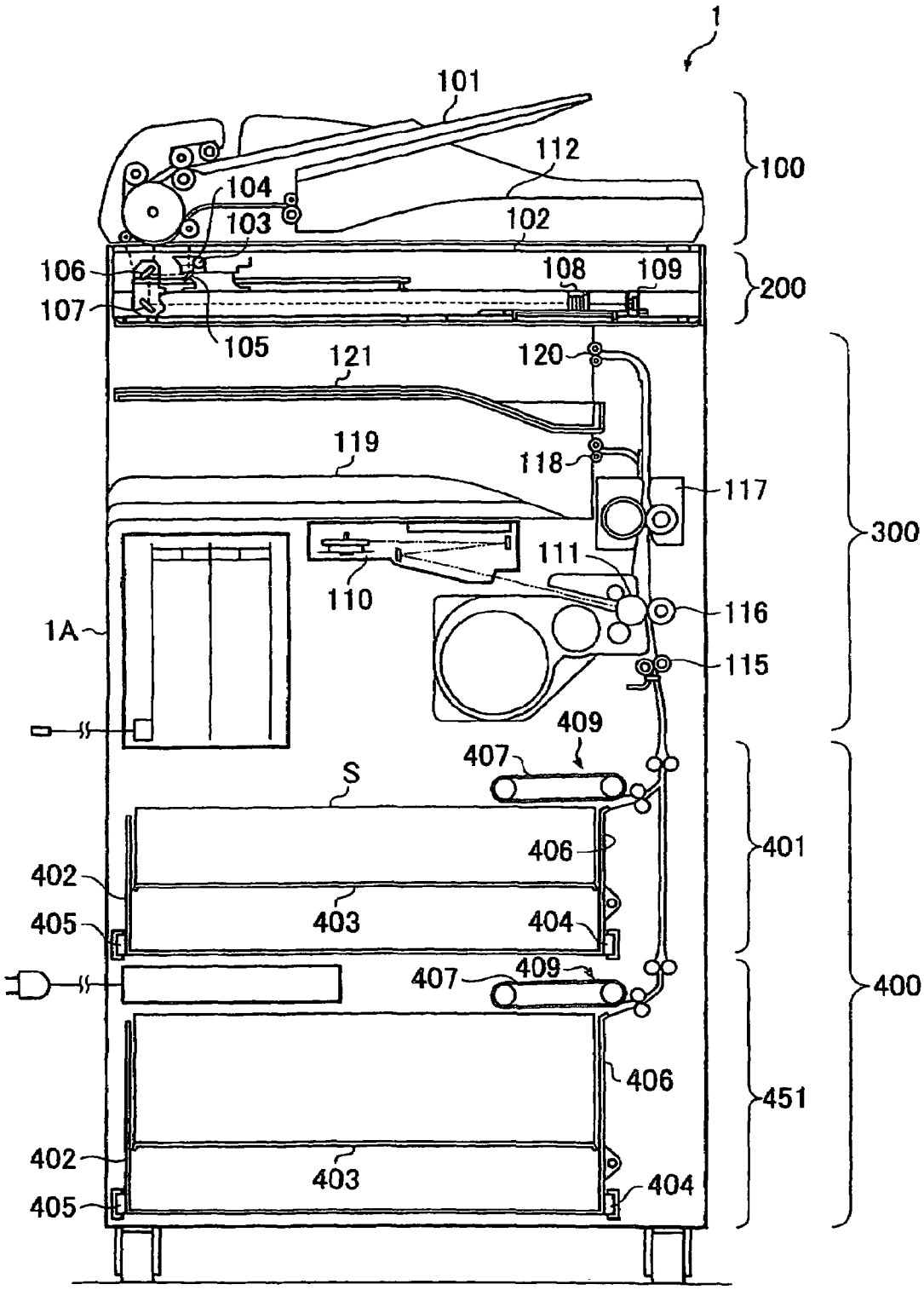
FIG. 1 is a sectional view illustrating an imaging apparatus.

FIG. 1 represents an imaging device as is known from US 2004/0089994 A1 and described elaborately in the paragraphs [0024] to [0034] of this US patent application which paragraphs are incorporated herein be reference. This apparatus includes an image reader 200, a printer 300 and a paper feed section 400. This section has paper decks 401 and 451 that share a paper feeding mechanism.

The image reader is equipped with a so called ADF 100. This ADF automatically feeds original documents to the image reader 200, in particular from tray 101 to glass platen 102. Thereafter, it discharges the sheets to paper discharge tray 112. When the original passes platen 102 it is read by scanner unit 104. This unit comprises lamp 103, the light of which is reflected via the original to lens 108 and further through mirrors 105, 106 and 107. Ultimately, the light forms an image on image sensor 109. This sensor converts the optical image into image data which data are outputted from the sensor and subjected to a predetermined processing in an image signal control unit (not shown). Then, the image data are inputted as video signals to an exposure control section 110 of printer 300. The exposure control section 110 modulates laser light and outputs this light on the photosensitive drum 111. The electrostatic latent image on the drum 111 is visualised by application of a developer supplied by a developing device (not shown). A resist roller 115 conveys the sheet fed by the paper decks 401 and 451, between the drum 111 and a transfer section 116 in a timed relation with the laser light. The sheet on which the developer image has been transferred is conveyed to fixing section 117 and then discharged to tray 119 by a first discharge roller 118, or discharged to tray 121 by the second discharge roller 120.

Next, the air sheet feeding and stacking units, i.e., the paper decks 401 and 451 will be described. Here, the paper decks 401 and 451 are only different in the maximum number of storage sheets, and hence, the same reference numbers are used to denote the same or equivalent components. The following description is based on paper deck 401.

Figure 2:
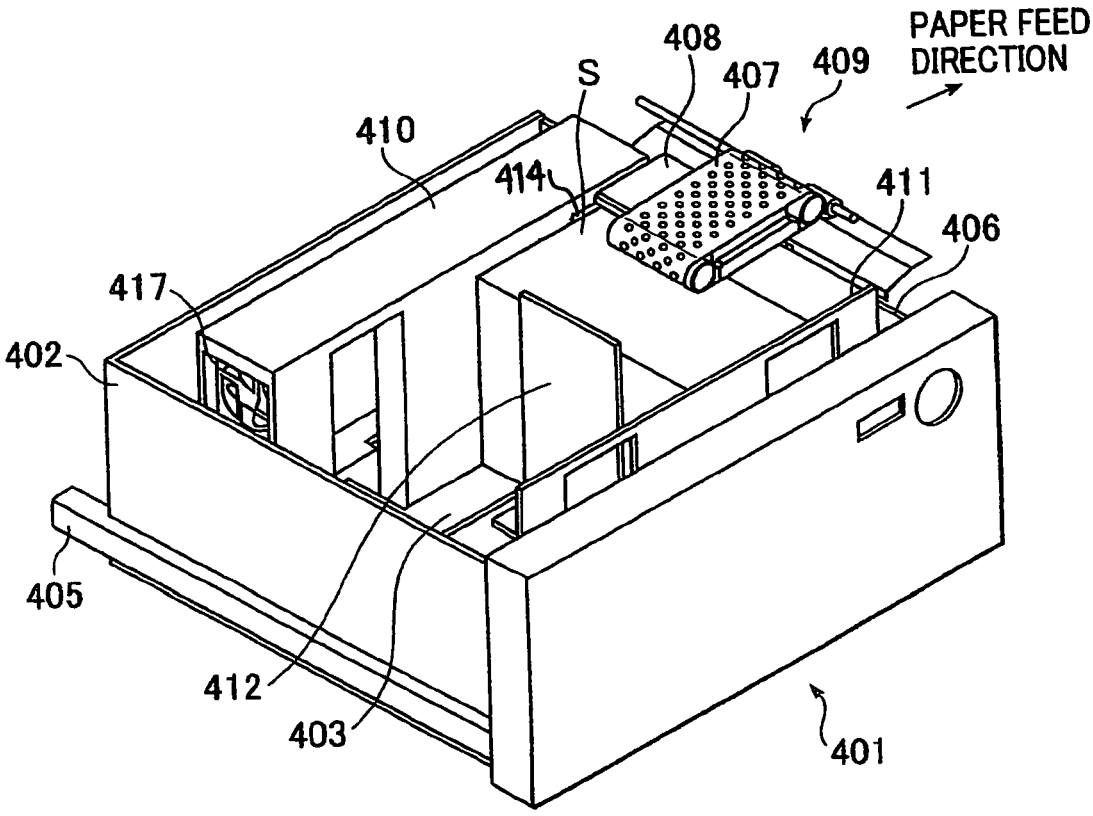
FIG. 2 is a perspective view representing a sheet stacking and feeding unit.

FIG. 2 is a perspective view of the air sheet-feeding paper deck 401. The paper deck is arranged to stack and store a sheet bundle S on a bottom plate 403. This bottom plate is provided in a repository 402 and is movable up and down. At the respective lower edges on the opposite sides of the repository 402, there are provided rails 404 and 405, which can be drawn to the front side with respect to the imaging apparatus body (i.e., to the operator side of the apparatus). The front end and rear end of the bundle S are fixedly placed in predetermined positions by plates 406 and 412. The opposite side edges are respectively placed in predetermined positions by side regulating plates 410 and 411.

At a position above the sheet bundle S, there is provided a sheet feed section 409 serving as a sheet suction and conveying means for the uppermost sheet of the bundle. The sheet feed section 409 has a suction duct 408 connected to a suction generating unit (not shown) for generating a suction pressure above the sheet bundle. A suction belt 407, capable of paper feed rotation in the paper feed direction, is provided with a large number of holes and surrounds the suction duct 408. The sheet feed section 409 feeds a sheet by causing the uppermost sheet to adhere to the suction belt 407 and rotating the belt in the paper feed direction.

Figure 3:
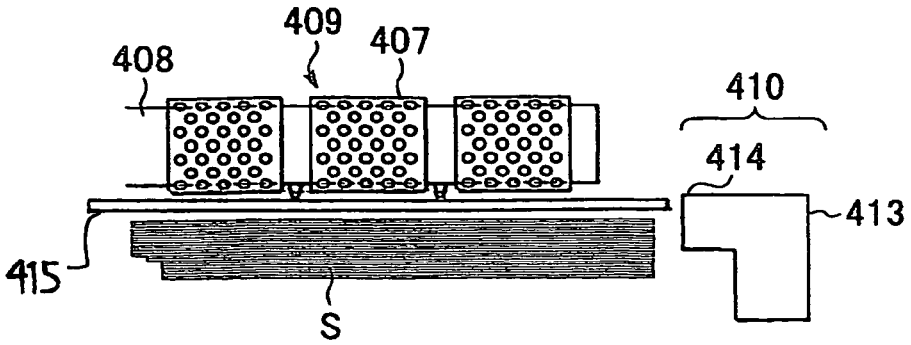
FIGS. 3A to 3C, illustrate the lifting and separation action when feeding a single sheet.
Figure 3:
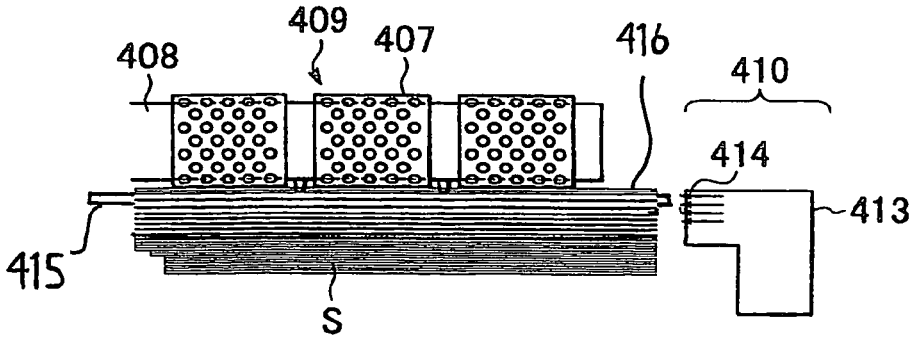
Figure 3:
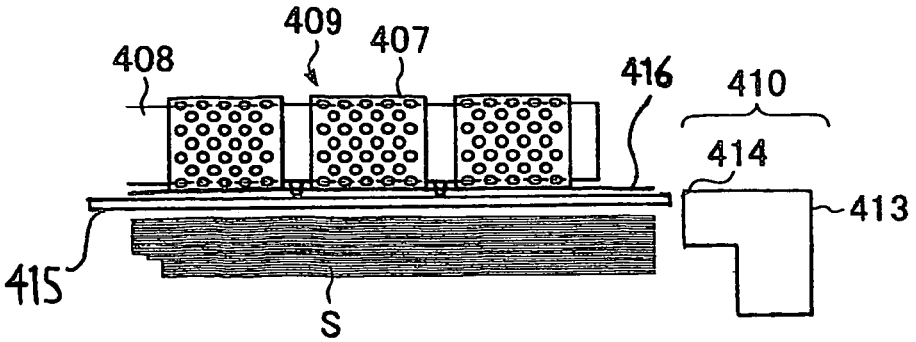

In FIGS. 3A to 3C the construction and operation of the air blowing means and separation action of the present invention will be outlined in greater detail. FIGS. 3A to 3C are sectional views when FIG. 2 is seen from the paper feed direction. Here the side regulating plate 410 has therein a structure which serves as the air blowing means. This air blowing means includes a blowing fan 417 (see FIG. 2) serving as the supply source of blown air, and a blowing duct 413 having at one end thereof an opening 414 (see also FIG. 2) that is opened facing the side edge of the sheet bundle S stacked in the repository 402. There is also provided an air knife 415 which has a very thin elongated opening for blowing air against the front end side of the sheet bundle S, in particular between the two uppermost sheets.

The operations of the sheet feed system are now described here below. When a sheet bundle is set in deck 401, the bottom plate 403 is lift up to a predetermined height by using sheet height detection means (not shown) and a lift-up motor (not shown). In this embodiment, pressing a start button of the imaging apparatus starts the paper feeding operation.

As illustrated in FIG. 3B, first the air blowing means 413 starts to blow air against the side edge of bundle S. This creates a lift-up action for the uppermost 5 to 7 sheets (in this particular embodiment). Then, the suction generating unit located at the upper position starts a suction operation, and the suction duct 408 starts the suction action. At the same time air is blown through air knife 415 and injected between the uppermost sheet and the second sheet. This also forces the uppermost sheet to be lifted somewhat more in the direction of suction unit 409. This leads to sheet 416 being attracted to the suction belt 407. Then, the air knife and air blowing means stop their blowing action so that the sheets that have been lifted off fall back in the direction of the bottom plate (see FIG. 3C). By drive-rotating the suction belt 407 at this point of time, sheet 416 is delivered. Repeating this operation allows sheets to be separately and reliably fed one by one. In order to also provide the same reliability when the bundle S is nearly depleted, for example when less than 10 sheets are present, there is provided for an extra means to assist in the lifting action caused by the air blowing means 413. The the means provided for creating this extra lifting action is outlined in greater herein below.

Figure 4:
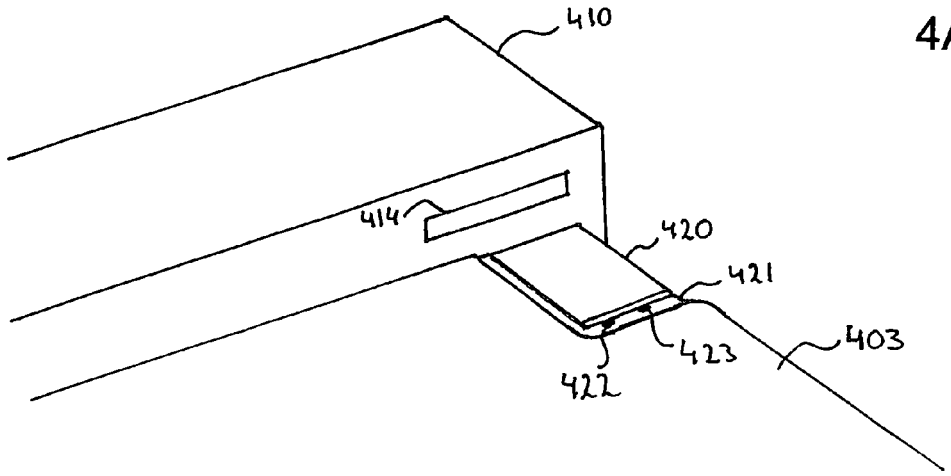
FIG. 4 shows a part of the bottom plate of the sheet stacking unit according to the present invention.
Figure 4:
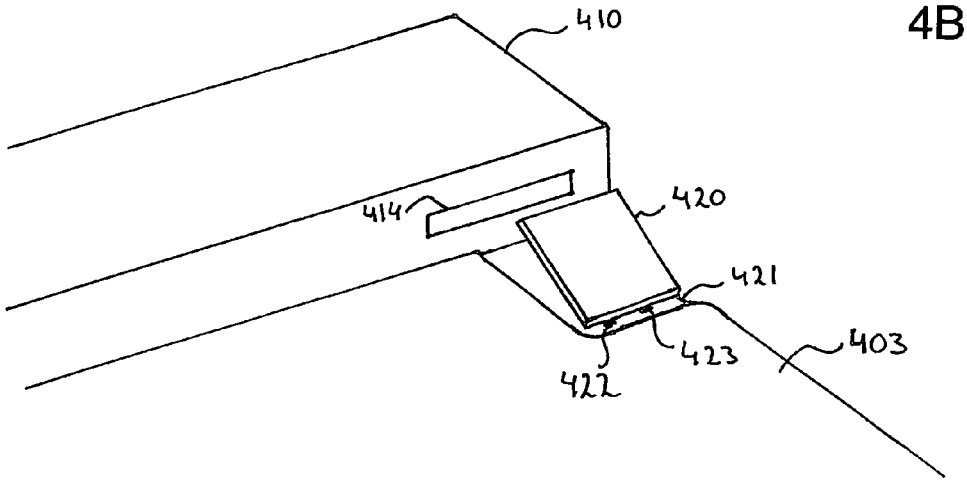

FIGS. 4A and 4B show a part of the bottom plate 403 of the sheet stacking unit according to the present invention. In this embodiment plate 403 is provided with a recess 421 adjacent opening 414 in side regulating plate 410. In the recess there is provided for a rigid plate 420, such that the upper surface of the rigid plate coincides with the upper surface of the bottom plate 403. Rigid plate 420 is connected to the bottom plate 403 via hinges 422 and 423. This enables the rigid plate to undertake a predetermined upward movement as is shown in FIG. 4B. This figure shows the upward movement of rigid plate 420 when the air blowing means blows air through opening 414 in the direction of bottom plate 403. It appears that the upward action of the rigid plate markedly improves the reliability of the sheet separation y. The reason for this might be that the rigid plate somehow resembles the lifting action that is also induced when a sufficient amount of sheets are present (i.e., when the sheet bundle is not nearly depleted). Note that the upward action of the rigid plate will only be undertaken when the bundle is nearly depleted. It is only when the bottom plate has been lifted far enough to reach the opening 414 that the rigid plate can be forced to undertake an upward movement due to the pressure difference caused by the air blowing means. Lastly it is noted that the rigid plate can also be part of a small overlay plate, e.g. a plate such as that of US design patent 249,695.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A method of dispensing sheets from a sheet bundle in a sheet stacking unit with a bottom plate for supporting the sheet bundle which comprises:

blowing air against a side edge of the sheet bundle near the topmost sheets of the sheet bundle, thereby lifting the topmost sheets from the sheet bundle, separating the uppermost sheet from the sheet bundle, and conveying this uppermost sheet away from the sheet bundle;

wherein the lifting of the sheets from the sheet bundle, upon the sheet bundle being nearly depleted, is assisted by forcing an element situated underneath the sheet bundle to push against the sheet bundle solely when air is blown against the side edge of the sheet bundle.

2. The method according to claim 1, wherein the blowing of the air creates a pressure difference that forces the element to undertake an upward movement.

3. The method according to claim 1, wherein the element pushes against the sheet bundle in a hinging action.

4. A sheet dispensing device which comprises:

a sheet stacking unit with a bottom plate for supporting a sheet bundle, air blowing means for blowing air against a side edge of the sheet bundle near the topmost sheets of the sheet bundle, thereby lifting the topmost sheets from the sheet bundle, sheet conveying means for conveying the uppermost sheet away from the sheet bundle, and an element disposed underneath the sheet bundle, said element being constructed such that it is adapted to push against the sheet bundle solely when air is blown against the side edge of the sheet bundle thereby assisting the lifting of sheets from the sheet bundle upon the sheet bundle being nearly depleted.

5. The sheet dispensing device of claim 4, wherein the element has the configuration of a sheet.

6. The sheet dispensing device of claim 5, wherein the element is a rigid plate that covers a part of the bottom plate.

7. The sheet dispensing device of claim 6, wherein the rigid plate is situated essentially adjacent the air blowing means.

8. The sheet dispensing device of claim 7, wherein the bottom plate has a recess in which the rigid plate is situated.

9. The sheet dispensing device of claim 4, wherein the element is hinged to the bottom plate.

10. An imaging apparatus containing the sheet dispensing device of claim 4.

11. The sheet dispensing device of claim 4 wherein the sheet bundle is nearly depleted when less than 10 to 25 sheets are remaining in the sheet bundle.

12. A sheet dispensing device which comprises:

a sheet stacking unit with a bottom plate for supporting a sheet bundle, air blowing means for blowing air against a side edge of the sheet bundle near the topmost sheets of the sheet bundle, thereby lifting these sheets from the sheet bundle, means for raising the bottom plate as the sheet bundle becomes depleted, and an element disposed underneath the sheet bundle, said element being constructed to push against the sheet bundle in cooperation with the blowing action of the air against the side edge of the bundle, said blowing of the air creating a pressure difference which produces a lifting force causing the element to move upwardly against the sheet bundle separately from said bottom plate, thereby facilitating the lifting of the residual sheets from the sheet bundle solely upon the sheet bundle being nearly depleted.

13. The sheet dispersing device of claim 12, wherein an air knife is positioned adjacent top sheets of the sheet bundle and on the opposite side of the sheet bundle from the air blowing means, said air knife cooperating with the air blowing means to separate the uppermost sheets from the sheet bundles and from each other.

* * * * *